United States Patent [19]

Griffith et al.

[11] Patent Number: 4,909,902

[45] Date of Patent: Mar. 20, 1990

[54] ALKALI METAL KURROL'S SALT AS A PAPER PULP DRAINING AID

[75] Inventors: Edward J. Griffith, Manchester; Toan M. Ngo, Eureka, both of Mo.

[73] Assignee: Monsanto Company, St. Louis, Mo.

[21] Appl. No.: 290,559

[22] Filed: Dec. 27, 1988

[51] Int. Cl.[4] ..... D21H 3/66

[52] U.S. Cl. ..... 162/181.2; 162/183

[58] Field of Search ..... 162/181.1, 181.2, 183, 162/199

[56] References Cited

U.S. PATENT DOCUMENTS

| | | | |
|---|---|---|---|
| 2,732,295 | 1/1956 | Hollenberg | 162/181.2 |
| 2,754,207 | 7/1956 | Schur et al. | 162/181.1 |
| 3,144,380 | 8/1964 | Drennen | 162/181.1 |
| 3,146,158 | 8/1964 | Donnelly | 162/181.1 |
| 3,926,718 | 12/1975 | Cuilbault et al. | 162/168 |
| 4,311,805 | 1/1982 | Moritani et al. | 525/60 |
| 4,565,604 | 1/1986 | Hansson et al. | 162/168.2 |
| 4,614,762 | 9/1986 | Marans et al. | 525/61 |

*Primary Examiner*—Peter Chin

*Attorney, Agent, or Firm*—Lawrence L. Limpus

[57] ABSTRACT

A process for the manufacture of paper and paper products is disclosed in which an alkali metal Kurrol's salt, preferably potassium Kurrol's salt, is added to the process water to improve the process water drainage from the paper pulp.

20 Claims, No Drawings

ALKALI METAL KURROL'S SALT AS A PAPER PULP DRAINING AID

BACKGROUND OF THE INVENTION

This invention relates to the improved process for the manufacture of paper and paper products wherein alkali metal Kurrol's salts are employed as a drainage and retention aid.

More particularly, this invention relates to the use of potassium Kurrol's salt as a drainage and retention aid in the manufacture of paper and paper products. As used herein, the terms "paper" and "paper products" mean a product formed from a wet-laid web of fibrous materials such as wood, bagasse, synthetic polymers such as polypropylene, polyethylene and the like, and any combinations thereof.

DESCRIPTION OF THE PRIOR ART

In modern paper making, an ever increasing emphasis is being placed on more complete recovery of furnish materials, such as pigments, fibers, and additives, as a part of the ultimate sheet. For the formation of the web in a paper making process, water in a pulp slurry is drained through a wire screen leaving the pulp fibers on top of the screen. The amount and rate of drainage and the increased retention of fine particulate matter in the web of pulp have a direct relationship with the efficiency of the paper production process and the quality of the resultant paper product. The paper maker will benefit from a better economic utilization of the furnish material, improved quality of the resultant paper product, cleaner white water effluent, and an increase in paper production which results from the increased rate of water drainage from the pulp.

A large variety of materials have been used to provide increased drainage rate and as retention aids. The most widely used of these are salts of aluminum, in particular aluminum sulfate, sodium aluminate, and sodium phosphoaluminate. These materials, however, have the defects of being required to be used in large amounts and of not being highly efficient retention aids.

Various polymeric materials, from naturally occurring gums to synthetic resins have also been used as retention aids. These include natural and chemically modified starches which are normally retained in the sheet product. The latter category includes polymers based on polyethyleneimine which exhibits excellent properties with respect to drainage and retention of fines in the paper making process. Its use, however, has been drastically limited because the starting monomer, ethyleneimine, is a known carcinogen.

Synthetic, water soluble polyelectrolytes which are cationic or anionic have also been used. Anionic polyelectrolytes are generally of the polyacrylamide type which has been partially hydrolyzed to thereby contained from 5 to 30 mol percent carboxyl groups. The cationic polymers found useful are ones which generally contain cationic nitrogen-containing groups which may be in the form of free amino groups or of quaternary ammonium salts. These polymers are deficient because of their low charge density and/or their low molecular weight.

SUMMARY OF THE INVENTION

This invention is directed to an improved process for making paper. An alkali metal Kurrol's salt, preferably Potassium Kurrol's salt, is added to the process water to improve the rate and amount of water drainage from the pulp slurry while also acting as a retention aid to improve the retention of fine particles in the pulp as the water is drained. Further benefits from the use of potassium Kurrol's salt include energy savings resulting from a reduction in the process water drag through the fan pump.

Potassium Kurrol's salt in a range of from about 5 parts per million (5 ppm) to about 150 parts per million (150 ppm), preferably in a range of from about 5 ppm to about 100 ppm, and more preferably in a range of from about 5 ppm to about 50 ppm is added to the process water. In this application concentrations expressed in "parts per million" shall mean parts per million by weight. The ratio of potassium to phosphorus is also important and it is desired that the $K_2O/P_2O_5$ mole ratio be within a range of from about 0.80 to about 1.05, preferably in a range of from about 0.80 to about 0.98, and more preferably the ratio is about 0.98. During the manufacture of the potassium Kurrol's salt the $K_2O/P_2O_5$ mole ratio may be changed by varying the ratio of potassium carbonate to phosphoric acid. Therefore, for example, excess phosphoric acid may be added during the manufacture of potassium Kurrol's salt so that the mole ratio of $K_2O$ to $P_2O_5$ ($K_2O/P_2O_5$) is reduced from 1.0 to the preferred range of from about 0.80 to about 0.98.

The addition of potassium Kurrol's salt with the mole ratio of $K_2O/P_2O_5$ between about 0.80 and about 1.05 to the process water of a paper making process will cause water to drain from the pulp slurry during the formation of the web as much as twice as fast as the drainage of water without the addition of potassium Kurrol's salt. In addition, the drained web of pulp in the system treated with the potassium Kurrol's salt contained significantly less water, that is, up to one third less water, than the web of pulp in the untreated system.

DESCRIPTION OF THE PREFERRED EMBODIMENTS

Potassium Kurrol's salt is added to the process water in the paper making process to improve the rate and amount of water drainage from the pulp slurry while also acting as a retention aid to improve the retention of fine particles in the pulp as the water is drained. Other Kurrol's salts made from the alkali metal salts, that is sodium, lithium, rubidium and cesium, may also be used; however, potassium Kurrol's salt is preferred as sodium Kurrol's salt is much more difficult to produce and the others are more expensive to produce.

Potassium Kurrol's salt is not readily soluble in water. However, the addition of diverse ions, for example, sodium ions, to the water with the potassium Kurrol's salt will make the potassium Kurrol's salt go into solution very rapidly. The liquid should be stirred during the addition of the potassium Kurrol's salt to reduce the time required for the salt to go into solution; however, severely rapid stirring may cause a high shear rate which will break the large molecules that are formed in the solution.

The potassium Kurrol's salt is added to the process water in a range of from about 5 ppm to about 150 ppm. It is possible to use a solution containing greater than about 150 ppm of potassium Kurrol's salt but the excess Kurrol's salt may increase the cost without proportionately increasing the water drainage and other benefits achieved by this invention. A solution containing less than about 5 ppm of potassium Kurrol's salt may lose its efficiency and fail to provide the benefits expected from this invention because the salt may be removed from the solution by absorption into the paper pulp.

Numerous materials, including lithium, sodium, ammonium, cesium, and rubidium, among others, may be used to provide the diverse ions required in the solution to make the potassium Kurrol's salt readily soluble. Sodium ions are preferred because sodium is relatively inexpensive and it is nontoxic, whereas the other alkali metals may have some toxicity.

In the following examples the diverse ions are provided as sodium ions primarily in tetrasodium pyrophosphate (TSPP). Sodium hexametaphosphate (SHMP) and disodium pyrophosphate (SAPP) were also used. The TSPP was added to the solutions in the examples below in amounts sufficient to create solutions containing a ratio of TSPP (measured in parts per million in solution) to potassium Kurrol's salt (measured in parts per million in solution) within a range of from about 0.45 to about 0.75. However, this ratio may change greatly depending upon the material used as a source of diverse ions and the amount of TSPP, or other source of diverse ions, may be varied greatly without affecting this invention. It is only necessary to add diverse ions in an amount sufficient to render the potassium Kurrol's salt soluble. The speed at which the potassium Kurrol's salt dissolves is directly dependent upon the concentration of diverse ions in the solution. Even very small amounts of diverse ions will cause the potassium Kurrol's salt to enter the solution. The addition of greater amounts of TSPP or other diverse ions will increase the speed at which the potassium Kurrol's salt enters solution; but, the expense of adding additional amounts of TSPP or other materials must be balanced against the time required for the potassium Kurrol's salt to enter the solution.

The solution of potassium Kurrol's salt may be prepared using either a basic or an acidic solution, but the basic solution is preferred as it is the more stable system. Sodium is the preferred source of diverse ions and TSPP is a readily available, inexpensive source of sodium ions that is basic, dissolves easily in water, and contains a high ratio of sodium to phosphate ions. Other examples of sources of sodium ions include sodium hydroxide, sodium sulfate, sodium carbonate, sodium hexametaphosphate, disodium pyrophosphate, sodium chloride, sodium borate, sodium bicarbonate, sodium tripolyphosphate, sodium formate, sodium acetate, sodium propionate, sodium citrate, sodium tartrate, sodium oxide, sodium peroxide, sodium perborate, sodium nitrate, sodium lactate, trisodium phosphate, and disodium phosphate.

The ratio of potassium to phosphorus is important. To improve the water drainage from the pulp slurry and to reduce the water drag through the pumping means such as the fan pump, it is preferred that the potassium Kurrol's salt added to the process water in the paper making process have a $K_2O$ to $P_2O_5$ mole ratio within a range of from about 0.80 to about 1.05. It is more preferred that the $K_2O/P_2O_5$ mole ratio be within a range of from about 0.80 to about 0.98. It is even more preferred that the mole ratio of $K_2O/P_2O_5$ be about 0.98. During the manufacture of the potassium Kurrol's salt, the $K_2O/P_2O_5$ mole ratio may be varied by changing the ratio of the potassium and the phosphorus compounds, for example, the ratio of potassium carbonate to phosphoric acid may be varied to change the $K_2O/P_2O_5$ mole ratio to any desired ratio within the range of from about 0.80 to about 1.05. The mole ratio may be adjusted, for example, by the addition of excess phosphoric acid during the manufacture of the potassium Kurrol's salt to reduce the $K_2O/P_2O_5$ mole ratio from 1.0 to 0.98 or less, and preferably to reduce the $K_2O/P_2O_5$ mole ratio to within the preferred range of from about 0.80 to about 0.98.

The invention will be better understood by the following examples which illustrate, but do not limit, the preparation and effectiveness of this invention, the use of potassium Kurrol's salt in the process for the manufacture of paper and paper products. In the tables showing the results of the following examples, potassium Kurrol's salt is identified by the formula "$(KPO_3)n$".

EXAMPLE 1

Forty (40) grams of Whatman filter paper #1 were cut into small pieces and placed in a blender. Then 500 ml of distilled water were added to the blender to soak the filter paper and the blender was run at low speed for three minutes to reduce the filter paper to smaller particles or pulp and to disperse the filter paper particles within the distilled water. A portion of the mixture, approximately 350 ml, was removed from the blender and filtered to determine the time that would be required for the liquid to drain from the filter paper pulp. This experiment was repeated four times with the volume of water drained from the paper pulp, the drainage time, and the weight of the pulp and retained water on the filter being measured each time. A summary of the measured results is shown in Table I below.

EXAMPLE 2

The preparation of the mixture of Example 1 was repeated by cutting 40 grams of Whatman filter paper #1 into small pieces and placing it in a blender with 500 ml of distilled water. However, before adding the water to the blender, potassium Kurrol's salt having a $K_2O/P_2O_5$ mole ratio of about 0.98 and disodium pyrophosphate (SAPP) were added to the distilled water in sufficient quantities to create a solution containing 100 ppm of potassium Kurrol's salt and 75 ppm of SAPP. Following blending at low speed for three minutes, a portion of the mixture, approximately 350 ml, was removed from the blender and filtered. As in Example 1, the volume of water drained from the paper pulp, the drainage time, and the weight of the pulp and retained water remaining on the filter after the filtering were measured. This experiment was repeated twice and a summary of the measured results is shown in Table I below. The experiment was repeated an additional two times with the substitution of 75 ppm of sodium tripolyphosphate (STP) for the 75 ppm of SAPP and a summary of the measured results is also shown in Table I below.

EXAMPLE 3

The mixture of Example 1 was again prepared by cutting 40 grams of Whatman filter paper #1 into small pieces and placing it into a blender with 500 ml of distilled water. Before adding the water to the blender, a sufficient amount of potassium Kurrol's salt and of tetrasodium pyrophosphate (TSPP) was added to the distilled water to prepare a solution containing 50 ppm of potassium Kurrol's salt and 20 ppm of TSPP. The potassium Kurrol's salt had a $K_2O/P_2O_5$ mole ratio of about 0.98. Following blending of the mixture in the blender, approximately 350 ml of the mixture were removed from the blender and filtered. As in Example 1, the volume of water drained from the paper pulp, the drainage time, and the weight of the pulp and retained water remaining on the filter after the filtering were measured. This experiment was repeated twice and a summary of the results is shown in Table I below.

EXAMPLE 4

The mixture of Example 1 was prepared for a fourth time with 40 grams of chopped Whatman filter per #1 placed into a blender with 500 ml of distilled water. A sufficient amount of potassium Kurrol's salt having a $K_2O/P_2O_5$ mole ratio of about 0.98 and of TSPP was added to the distilled water before it was added to the blender to produce a solution containing 75 ppm of potassium Kurrol's salt and 50 ppm of TSPP. After blending the liquid and the filter paper in the blender for three minutes, approximately 350 ml of the mixture were removed from the blender and filtered. Again, as in Example 1, the volume of water drained from the paper pulp, the drainage time, and the weight of the pulp and retained water remaining on the filter after the filtering were measured. This experiment was repeated twice and a summary of the results is shown in Table I below.

EXAMPLE 5

Mixtures of pulp and liquid similar to the mixtures of Examples 1 and 2 were produced using a different pulp material. A mixture of hardwood and softwood pulp was first soaked. The water was filtered from the pulp and the pulp was then divided into equal portions by weight. First and second mixtures were made by stirring 35 grams of pulp and 400 ml of distilled water together at low speed to disperse the pulp throughout the water. Each mixture was then filtered to determine the volume of water drained from the pulp, the drainage time, and the weight of the pulp and water remaining on the filter. A third mixture was prepared by mixing 35 grams of the pulp with 400 ml of distilled water which contained 10 ppm of potassium Kurrol's salt and 5 ppm TSPP. The potassium Kurrol's salt had a $K_2O/P_2O_5$ mole ratio of about 0.98. As with the first and second pulp and water mixtures in this Example, this mixture was stirred at low speed to disperse the pulp throughout the liquid. The mixture was then filtered and the volume of water drained from the pulp, the drainage time, and the weight of the pulp plus water remaining on the filter after the filtering were measured. A summary of the measurements taken for these three mixtures is shown in Table I below.

TABLE I

| | Sample No. | Additives | Water Drained | Drainage Time | Pulp Plus Water Residue |
|---|---|---|---|---|---|
| Example 1 | A | | 340 ml | 4.80 minutes | 27.0 grams |
| | B | | 343 | 3.45 | 21.3 |
| | C | | 289 | 3.40 | 66.0 |
| | D | | 342 | 3.39 | 21.02 |
| Example 2 | A | 100 ppm $(KPO_3)n$ + 75 ppm SAPP | 345 ml | 2.52 minutes | 16.9 grams |
| | B | " | 344.5 | 1.75 | 16.8 |
| | C | 100 ppm $(KPO_3)_n$ + 75 ppm STP | 344.5 | 2.71 17.6 | |
| | D | " | 336. | 2.52 | 37.3 |
| Example 3 | A | 50 ppm $(KPO_3)n$ + 30 ppm TSPP | 341 ml | 2.47 minutes | 20.51 grams |
| | B | " | 241 | 2.78 | 26.13 |
| Example 4 | A | 75 ppm $(KPO_3)n$ + 50 ppm TSPP | 349 ml | 1.85 minutes | 14.1 grams |
| | B | " | 345 | 1.37 | 12.97 |
| Example 5 | A | | 427 ml | 5.0 minutes | 13.43 grams |
| | B | | 424 | 5.0 | 18.34 |
| | C | 10 ppm $(KPO_3)n$ + 5 ppm TSPP | 426 | 4.46 | 14.07 |

EXAMPLE 6

The following experiments were performed starting with a fixed volume of pulp and liquid. The time required for the liquid to drain to reach a predetermined end point was measured to determine the effect of the use of potassium Kurrol's salt to increase the speed of liquid drainage from the paper pulp. As a control in the experiments to determine the effect of the use of potassium Kurrol's salt to increase the speed of liquid drainage from the paper pulp, Whatman filter paper #1 was cut into small pieces and 12 grams of the paper were put into a blender with 500 ml of distilled water. The blender was run at low speed for five minutes to disperse the paper pulp throughout the volume of water. The mixture was poured into a four liter container and, while stirring, additional distilled water was added to dilute the mixture to a total volume of three liters. The mixture was then filtered using a screen which weighed 47.23 grams. The wet weight, that is, the weight of the screen and paper pulp with the retained water, and the filtering time required to reach that wet weight are shown in Table II below.

EXAMPLE 7

The procedure of Example 6 was repeated with slight modifications for the addition of potassium Kurrol's salt to the distilled water. Whatman filter paper #1 was cut into small pieces and 12 grams of paper were put into a blender with 500 ml of distilled water. The blender was run at low speed for five minutes to disperse the paper pulp throughout the liquid. The mixture was then poured into a four liter container. A concentrated solution of potassium Kurrol's salt which had a $K_2O/P_2O_5$ mole ratio of about 0.98 and TSPP was poured into the blender which was run at slow speed for 30 seconds. The concentrated solution was then poured into the four liter container with the paper pulp and the distilled water and additional distilled water was added to dilute the entire mixture to a total volume of three liters. The potassium Kurrol's salt and TSPP in the concentrated solution were limited to the amount required to produce a concentration of 15 ppm of potassium Kurrol's salt and 7.5 ppm of TSPP in the final three liter volume of paper pulp and liquid. The mixture was mechanically stirred for two minutes before filtering with a screen which weighed 47.23 grams. The final wet weight, that is the weight of the screen plus the paper pulp and the retained water, and the time required for the three liters of mixture to be filtered to reach the final wet weight is shown in Table II below.

EXAMPLE 8

The procedure of Example 7 was repeated using different concentrations of potassium Kurrol's salt. The wet weight and the time measured in the experiments of this Example are shown in Table II below.

EXAMPLE 9

The procedure of Example 6 was repeated with a mixture containing a greater amount of paper pulp. A mixture was made by putting 1% by weight of Whatman filter paper #1, cut into small pieces, into a blender with three liters of distilled water. The mixture was blended at low speed for six minutes to disperse the paper pulp throughout the volume of water before being filtered using a screen which weighed 47.23 grams. The wet weight and the filtering time are shown in Table II below.

EXAMPLE 10

The procedure of Example 9 was repeated using a modified procedure for the addition of different concentrations of potassium Kurrol's salt. A mixture was prepared comprising 1% by weight of Whatman filter paper #1 pulp in three liters of distilled water. The filter paper was cut into small pieces and put into a blender with 500 ml of distilled water. The blender was run at low speed for five minutes to disperse the paper pulp throughout the liquid. The mixture was then poured into a four liter container. A concentrated solution of potassium Kurrol's salt which had a $K_2O/P_2O_5$ mole ratio of about 0.98 and TSPP was poured into the blender which was run at slow speed for 30 seconds. The concentrated solution was then poured into the four liter container with the paper pulp and the distilled water and additional distilled water was added to dilute the entire mixture to a total volume of three liters. The potassium Kurrol's salt and TSPP in the concentrated solution was limited to the amount required to produce the desired concentration of potassium Kurrol's salt and of TSPP in the final three liter volume of paper pulp and liquid. The different desired concentrations are shown in Table II below. The mixture was mechanically stirred for two minutes before filtering with a screen which weighed 47.23 grams. The concentration of potassium Kurrol's salt, the wet weight, that is the weight of the screen plus the paper pulp and the retained water, and the time required for the three liters of mixture to be filtered to reach the final wet weight are shown in Table II below.

EXAMPLE 11

The procedure of Example 6 was repeated with a mixture containing a greater amount and a different kind of paper pulp. A mixture was made by putting 1% by weight of Whatman filter paper #4, cut into small pieces, into a blender with three liters of distilled water. The mixture was blended at low speed to disperse the paper pulp throughout the volume of water before being filtered using a screen which weighed 47.23 grams. The wet weight and the filtering time are shown in Table II below.

EXAMPLE 12

The procedure of Example 11 was repeated with the exception that different concentrations of potassium Kurrol's salt were added to the solution. A mixture was prepared comprising 1% by weight of Whatman filter paper #4 pulp in three liters of distilled water. The filter paper was cut into small pieces and put into a blender with 500 ml of distilled water. The blender was run at low speed for five minutes to disperse the paper pulp throughout the liquid. The mixture was then poured into a four liter container. A concentrated solution of potassium Kurrol's salt which had a $K_2O/P_2O_5$ mole ratio of about 0.98 and TSPP was poured into a blender which was run at slow speed for 30 seconds. The concentrated solution was then poured into the four liter container with the paper pulp and the distilled water and additional distilled water was added to dilute the entire mixture to a total volume of three liters. The potassium Kurrol's salt and TSPP in the concentrated solution was limited to the amount required to produce the desired concentration of potassium Kurrol's salt and of TSPP in the final three liter volume of paper pulp and liquid. The different desired concentrations are shown in Table II below. The mixture was mechanically stirred for two minutes before filtering with a screen which weighed 47.23 grams. The concentration of potassium Kurrol's salt, the wet weight, that is the weight of the screen plus the paper pulp and the retained water, and the time required for the three liters of mixture to be filtered to reach the final wet weight are shown in Table II below.

EXAMPLE 13

The procedures mixing pulp and distilled water and mixing pulp and distilled water containing potassium Kurrol's salt, were repeated using bleached softwood pulp. A mixture was made by blending the softwood pulp and distilled water in a blender and then diluting the mixture with additional distilled water to make a sample having a total volume of three liters. Additional mixtures were made with potassium Kurrol's salt which had a $K_2O/P_2O_5$ mole ratio of about 0.98 and TSFP added to produce a concentration of 10 ppm potassium Kurrol's salt and 5 ppm of TSPP in the final three liter volume of pulp and liquid. Each sample was mechanically stirred before filtering with a screen which weighed 47.23 grams. The final wet weight and the time required for each of the three liters of mixture to be filtered to reach the final wet weight is shown in Table II below.

TABLE II

| | Sample No. | Additives | Final Net Weight | Drainage Time |
|---|---|---|---|---|
| Example 6 | A | | 124.83 grams | 5.0 seconds |

TABLE II-continued

| | Sample No. | Additives | Final Net Weight | Drainage Time |
|---|---|---|---|---|
| | B | | 125.28 | 5.0 |
| | C | | 124.82 | 5.1 |
| Example 7 | A | 15 ppm $(KPO_3)n$ + 7.5 ppm TSPP | 124.82 grams | 4.35 seconds |
| | B | " | 124.07 | 4.15 |
| Example 8 | A | | 124.88 grams | 4.5 seconds |
| | B | 25 ppm $(KPO_3)n$ + 12.5 ppm TSPP | 125.59 | 4.4 |
| | C | 10 ppm $(KPO_3)n$ + 5 ppm TSPP | 130.04 | 4.3 |
| | D | " | 128.58 | 3.2 |
| | E | " | 126.91 | 3.4 |
| | F | 8 ppm $(KPO_3)n$ + 4 ppm TSPP | 125.33 | 3.2 |
| | G | 5 ppm $(KPO_3)n$ + 2.5 ppm TSPP | 126.69 | 3.3 |
| Example 9 | A | | 226.10 grams | 10.7 seconds |
| | B | | 226.34 | 11.5 |
| Example 10 | A | 50 ppm $(KPO_3)n$ + 25 ppm TSPP | 270.64 grams | 16.0 seconds |
| | B | 30 ppm $(KPO_3)n$ + 15 ppm TSPP | 286.68 | 13.7 |
| | C | " | 263.10 | 14.1 |
| | D | 10 ppm $(KPO_3)n$ + 5 ppm TSPP | 224.10 | 10.4 |
| | E | " | 229.68 | 10.6 |
| | F | " | 227.79 | 9.9 |
| | G | 7 ppm $(KPO_3)$ + 3.5 ppm TSPP | 221.34 | 9.4 |
| | H | " | 226.10 | 8.9 |
| | I | 5 ppm $(KPO_3)n$ + 2.5 ppm TSPP | 215.87 | 10.1 |
| | J | " | 240.70 | 9.6 |
| Example 11 | A | | 227.44 grams | 7.0 seconds |
| Example 12 | A | 30 ppm $(KPO_3)n$ + 15 ppm TSPP | 230.45 grams | 6.5 seconds |
| | B | " | 221.90 | 8.1 |
| | C | 45 ppm $(KPO_3)n$ + 20 ppm TSPP | 255.30 | 6.1 |
| | D | " | 259.10 | 8.8 |
| Example 13 | A | | 173.35 grams | 5.1 seconds |
| | B | | 165.65 | 5.0 |
| | C | 10 ppm $(KPO_3)n$ + 5 ppm TSPP | 158.78 | 4.1 |
| | D | " | 165.60 | 4.1 |
| | E | " | 160.10 | 4.0 |
| | F | " | 156.17 | 3.0 |

The experiments shown in the examples show that the addition of potassium Kurrol's salt to the liquid in a paper-making process substantially improves the rate at which the liquid drains from the pulp. These Examples also show that the addition of potassium Kurrol's salt to the liquid increases the amount of water that drains from the pulp, in addition to having the water drain faster.

As a result of the observation of the improvement in liquid drainage from paper pulp caused by the addition of potassium Kurrol's salt to the water pulp mixture, as shown in Examples 1–13 above, a pilot paper machine was operated to further exhibit the benefits derived from the addition of the polyphosphates to the water of the paper making process. The potassium Kurrol's salt was added at rates of 2.5 ppm, 5 ppm and 10 ppm based upon a head box flow of 14 gallons per minute. For evaluation of the benefits attributable to the addition of the potassium Kurrol's salt, a paper basis weight of 40 lbs., which corresponds to 167 dry grams of paper per minute on the reel, was chosen. During the paper machine run, the surface properties of dry paper samples were tested using the Gurley porosity and Sheffield smoothness tests. Cross-directional tensile strength was also measured to determine the strength gain or loss which could be attributed to the addition of the potassium Kurrol's salt. Table III shows the results of the testing during the operation of the paper machine. The Table shows that the addition of potassium Kurrol's salt to the process water did not adversely affect the properties of the paper that was produced.

TABLE III

| Test | $(KPO_3)_n$ | Gurley Porosity | Cross-Direction Tensile | Sheffield Smoothness Felt | Sheffield Smoothness Wire |
|---|---|---|---|---|---|
| A | 0 ppm | 13.7 secs. | 10.1 lb/in | 320 | 365 |
| B | 5 | 13.2 | 10.2 | 340 | 360 |
| C | 10 | 12.7 | 10.6 | 340 | 365 |
| D | 2.5 | 15.3 | 9.8 | 340 | 350 |

A further significant advantage derived from the use of potassium Kurrol's salt in the liquid of the paper making process is the energy savings that may be realized from the reduction of the drag on the circulating process water, particularly the water flow through a pumping means such as a the fan pump. Changes in the amount of potassium Kurrol's salt added to the process water significantly affected the fan pump flow. The addition of 5 ppm of potassium Kurrol's salt to the process water increased flow rate through the fan pump by approximately 5% while the fan pump motor operated at a constant speed. Reducing the addition of the potassium Kurrol's salt, while keeping the fan pump motor speed constant, caused a corresponding reduction in the process water flow rate through the fan pump.

The improvements in liquid flow rates and in the drainage of liquid from the paper pulp that were found may require a paper maker to change some machine operating variables, such as operating speeds or flow rates, for the most efficient operation on commercial machines.

The foregoing description of this invention is not intended as limiting of the invention. As will be apparent to those skilled in the art, many variations on and modifications to the embodiments described above may be madè without departure from the spirit and scope of this invention.

We claim:

1. In a process for making paper, the improvement comprising adding an alkali metal Kurrol's salt, and a source of diverse ions in an amount sufficient to render said Kurrols' salt soluble, to the process water.

2. The process of claim 1 wherein said Kurrol's salt is potassium Kurrol's salt.

3. The process of claim 2 wherein said potassium Kurrol's salt is added to the process water in an amount ranging from about 5 ppm to about 150 ppm.

4. The process of claim 3 wherein said potassium Kurrol's salt has a $K_2O/P_2O_5$ mole ratio between about 0.80 and about 1.05.

5. The process of claim 3 wherein said potassium Kurrol's salt is added to the process water in an amount ranging from about 5 ppm to about 100 ppm.

6. The process of claim 5 wherein said potassium Kurrol's salt is added to the process water in an amount ranging from about 5 ppm to about 50 ppm.

7. The process of claim 4 wherein said potassium Kurrol's salt has a $K_2O/P_2O_5$ mole ratio between about 0.80 and about 0.98.

8. The process of claim 7 wherein said potassium Kurrol's salt has a $K_2O/P_2O_5$ mole ratio of about 0.98.

9. In a process for making paper comprising providing a slurry of particles in process water and forming a sheet by means of separation of said process water from said particles by draining said water through a porous surface, the improvement comprising adding from about 0.5 ppm to about 150 ppm of potassium Kurrol's salt, and a source of diverse ions in an amount sufficient to make said potassium Kurrol's salt soluble, to the process water, said potassium Kurrol's salt having a $K_2O/P_2O_5$ mole ratio between about 0.80 and about 1.05.

10. The process of claim 9 wherein said potassium Kurrol's salt is added to the process water in an amount ranging from about 5 ppm to about 100 ppm.

11. The process of claim 10 wherein said potassium Kurrol's salt is added to the process water in an amount ranging from about 5 ppm to about 50 ppm.

12. The process of claim 9 wherein said potassium Kurrol's salt has a $K_2O/P_2O_5$ mole ratio between about 0.80 and about 0.98.

13. The process of claim 12 wherein said potassium Kurrol's salt has a $K_2O/P_2O_5$ mole ratio of about 0.98.

14. In a process for making paper, a process for improving process water drainage from paper pulp comprising adding from about 5 ppm to about 150 ppm of potassium Kurrol's salt, and a source of diverse ions in an amount sufficient to make said potassium Kurrol's salt soluble, to the process water, said potassium Kurrol's salt having a $K_2O/P_2O_5$ mole ratio between about 0.80 and about 1.05.

15. The process improvement of claim 14 wherein said potassium Kurrol's salt is added to the process water in an amount ranging from about 5 ppm to about 100 ppm.

16. The process improvement of claim 15 wherein said potassium Kurrol's salt is added to the process water in an amount ranging from about 5 ppm to about 50 ppm.

17. The process improvement of claim 14 wherein said potassium Kurrol's salt has a $K_2O/P_2O_5$ mole ratio between about 0.80 and about 0.98.

18. The process improvement of claim 17 wherein said potassium Kurrol's salt has a $K_2O/P_2O_5$ mole ratio of about 0.98.

19. The process improvement of claim 14 wherein said source of diverse ions is selected from the group consisting of lithium, sodium, ammonium, cesium, and rubidium.

20. The process improvement of claim 19 wherein said source of diverse ions is sodium.

* * * * *